US007189068B2

(12) United States Patent
Thomas, Jr. et al.

(10) Patent No.: US 7,189,068 B2
(45) Date of Patent: Mar. 13, 2007

(54) SOUND REDUCED ROTARY VANE COMPRESSOR

(75) Inventors: Delbert L. Thomas, Jr., Watervliet, MI (US); William S. Otte, Stevensville, MI (US); Lorraine Joan Westlake, Eau Claire, MI (US); Christopher Jaques, Coloma, MI (US)

(73) Assignee: Gast Manufacturing, Inc., Benton Harbor, MI (US)

( * ) Notice: Subject to any disclaimer, the term of this patent is extended or adjusted under 35 U.S.C. 154(b) by 488 days.

(21) Appl. No.: 10/666,061

(22) Filed: Sep. 19, 2003

(65) Prior Publication Data

US 2005/0063853 A1 Mar. 24, 2005

(51) Int. Cl.
*F01C 13/00* (2006.01)
*F03C 2/00* (2006.01)

(52) U.S. Cl. ..... 418/181; 418/179; 418/261; 418/259; 417/312; 181/269

(58) Field of Classification Search ..... 418/181, 418/179, 261, 259, 178, 152, 153; 417/312; 181/269, 255, 256, 272, 274
See application file for complete search history.

(56) References Cited

U.S. PATENT DOCUMENTS 2,643,731 A * 6/1953 Schmid ..... 418/181
2,925,786 A * 2/1960 Hill ..... 418/152
3,452,725 A * 7/1969 Kelly ..... 418/152
4,484,873 A 11/1984 Inagaki et al.
4,747,761 A * 5/1988 Yumiyama et al. ..... 418/181
4,826,407 A * 5/1989 Poole ..... 418/15
4,842,492 A 6/1989 Gannaway
4,932,851 A 6/1990 Kim
4,960,372 A 10/1990 Scheldorf et al.
4,975,031 A 12/1990 Bagepalli et al.
4,988,269 A 1/1991 Blass
5,063,098 A 11/1991 Niwa et al.
5,169,298 A 12/1992 Hekman et al.
5,271,142 A 12/1993 Moore, III et al.
5,382,132 A 1/1995 Mendel (Continued)

FOREIGN PATENT DOCUMENTS

JP 62159786 A * 7/1987 ..... 418/181

(Continued)

OTHER PUBLICATIONS

Catalogue "Rotary Vane Compressors and Vacuum Pumps" Gast A Unit of Idex Corp F-9 (Oct. 1998), Copyright 1998.

(Continued)

*Primary Examiner*—Theresa Trieu
(74) *Attorney, Agent, or Firm*—Miller Matthias & Hull

(57) ABSTRACT

A rotary vane compressor having features for reducing sound emitted from the compressor during operation. The sound reduction features include and relate to specific components of the compressor. Specifically the features relate to (1) the compressor motor; (2) a non-vented motor housing and back or closure; (3) the inlet ring; (4) the bearing system; (5) the rotor and vane positioning and vane weight or mass; (6) the mass of the body within which the rotor and vane rotate; and (7) a shroud which surrounds the body which is solid and non-vented solid and may be formed of a laminated material having a sound dampening core layer.

20 Claims, 10 Drawing Sheets

U.S. PATENT DOCUMENTS

| | | | | |
|---|---|---|---|---|
| 5,571,244 | A * | 11/1996 | Andres | 418/152 |
| 5,733,108 | A | 3/1998 | Riffe | |
| 5,910,470 | A | 6/1999 | Minami et al. | |
| 6,129,176 | A | 10/2000 | Hunsberger et al. | |
| 6,196,809 | B1 | 3/2001 | Takahashi et al. | |
| 6,270,329 | B1 | 8/2001 | Oshima et al. | |
| 6,790,019 | B1 * | 9/2004 | Hinchey, Jr. | 418/181 |
| 6,881,044 | B1 * | 4/2005 | Thomas et al. | 418/259 |

FOREIGN PATENT DOCUMENTS

| | | | | |
|---|---|---|---|---|
| JP | 03290083 A | * | 12/1991 | 418/181 |
| SU | 731000 A | * | 4/1980 | 418/181 |

OTHER PUBLICATIONS

Catalogue, "Roller Bearings,"Cat. No. A140, p. 19933-10, Printed in Japan, Copyright NSK Ltd. 1989.

Data Sheet Polyrex EM, Exxon Mobil Corporation 3225 Gallows Road Fairfax, VA 22037.

* cited by examiner

SOUND REDUCED ROTARY VANE COMPRESSOR

FIELD

This invention relates to rotary vane compressors and more particularly to an improved compressor which exhibits low sound emission due to a combination of improved elements.

BACKGROUND

Rotary vane compressors are used in a variety of applications. One such compressor includes a rotor having vane receiving slots with a vane in each slot. The rotor is rotated, in an eccentric manner, in a cavity within a body to produce compressed gas. One major application is in home sewage treatment. There the rotary vane compressor is used to pump air into home sewage treatment tanks to provide bacteria growth, which in turn, will break down the effluent in the tank. The compressor is typically located outside, next to the house and operates continuously.

A typical rotary vane compressor is sold by Gast Manufacturing, Inc. of Benton Harbor, Mich., 49023-0097 as its "23 Series". These compressors usually include the following components: (1) a motor in a vented housing having a bearing mounted drive shaft; (2) a vented back plate or closure for the motor housing; (3) a rear plate mounted to the housing and though which the shaft extends; (4) an inlet ring between the motor housing and rear plate; (5) a rotor with vanes mounted to the drive shaft, and positioned within a body; (6) a vented shroud surrounding the body which abuts the motor housing; (6) a front plate that bears against the body and rotor; and (7) a muffler box positioned against the front plate and through which air enters and exits the compressor.

The muffler box, front plate, body, rear plate and motor housing are secured together. The major moving parts are the motor, drive shaft, bearings and rotor with vanes all of which produce sound. However, vibration of the non-moving parts is also important. The compressor emits sound during operation, which due to its 24-hour operation can become irritating over time.

It is an object of this invention to reduce the sound of the compressor when it operates.

This and other objects of the invention will become apparent from the following description and independent claims.

SUMMARY

The compressor of this invention is quieter in operation and exhibits reduced sound emission. The compressor operates at sound levels of less than about 50 dBA (decibels) at one meter. This low sound level has been achieved by various improvements taken in combination. These include improvements relate to the motor, a shorter non-vented motor housing, a non-vented back plate for the motor housing, improved bearings for the drive shaft, and a change in the rotor carrying body such as an increased mass, a solid or non-vented shroud made of a laminated material that surrounds the body, modifications in the vane carrying rotor and optionally an improved muffler box made out of a cast iron, zinc or magnesium casting.

DESCRIPTION

Figure 1:
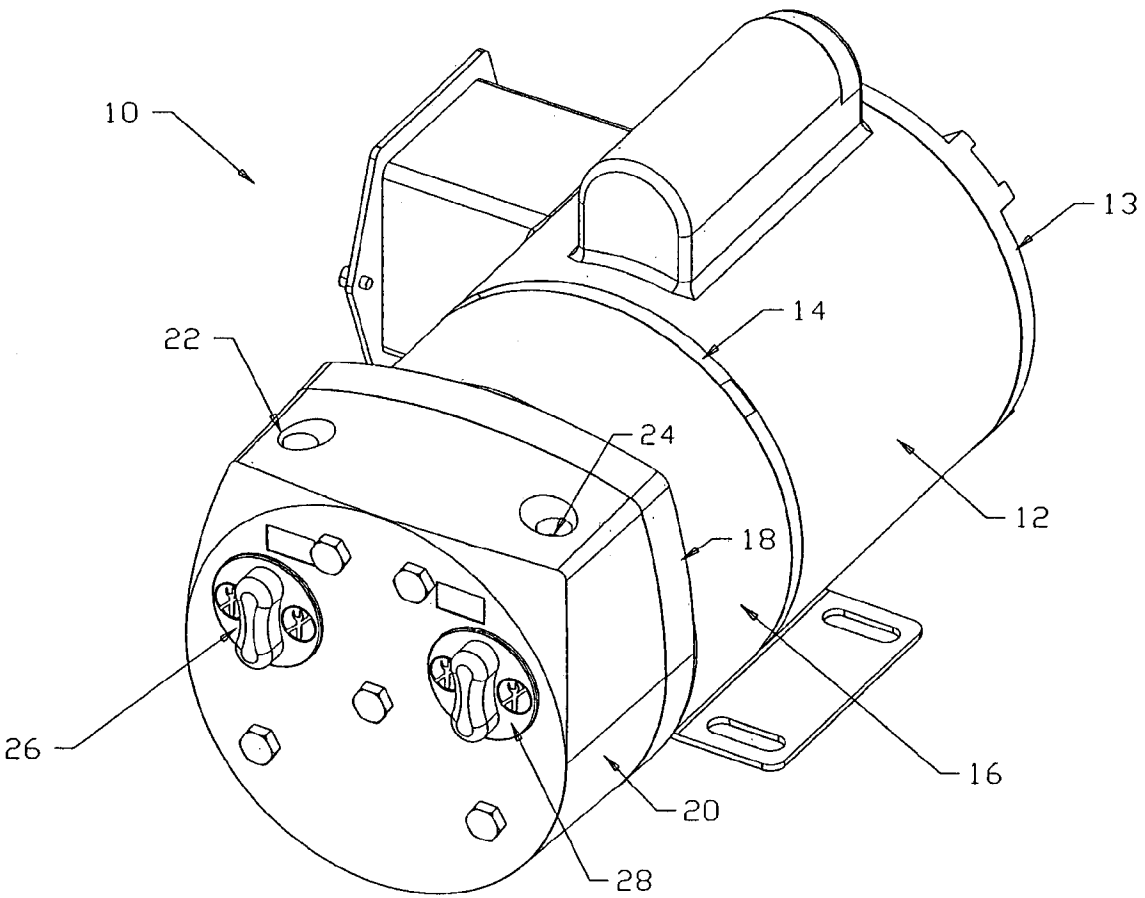
FIG. 1 is an isometric view of a sound-reduced rotary vane compressor.
Figure 2:
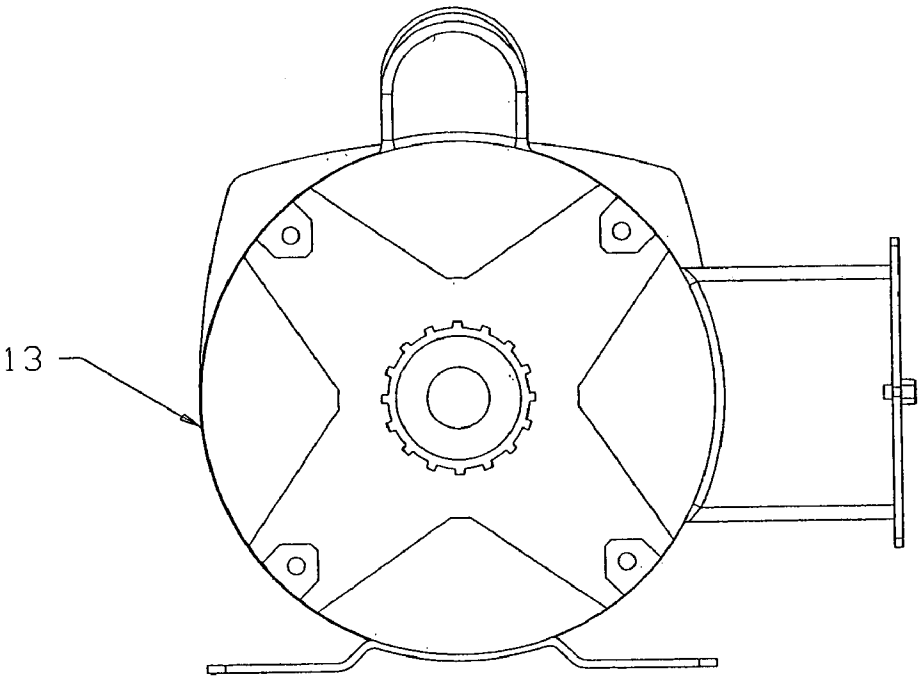
FIG. 2 is a back view of the compressor of FIG. 1.

The compressor 10 is shown in FIG. 1. Externally the compressor has a solid, non-vented motor housing 12, a non-vented back 13, a rear plate 14, a solid non-vented shroud 16, a front plate 18 and a muffler box 20. The components are bolted together so as to form a unit. Two ports 22 and 24 are provided in the muffler box for the entry of air and exit of compressed air. Muffler constructions 26 and 28 are provided for use in the muffler box. The rear or back 13 of the compressor is shown in FIG. 2 and includes a solid non-vented plate.

Figure 3:
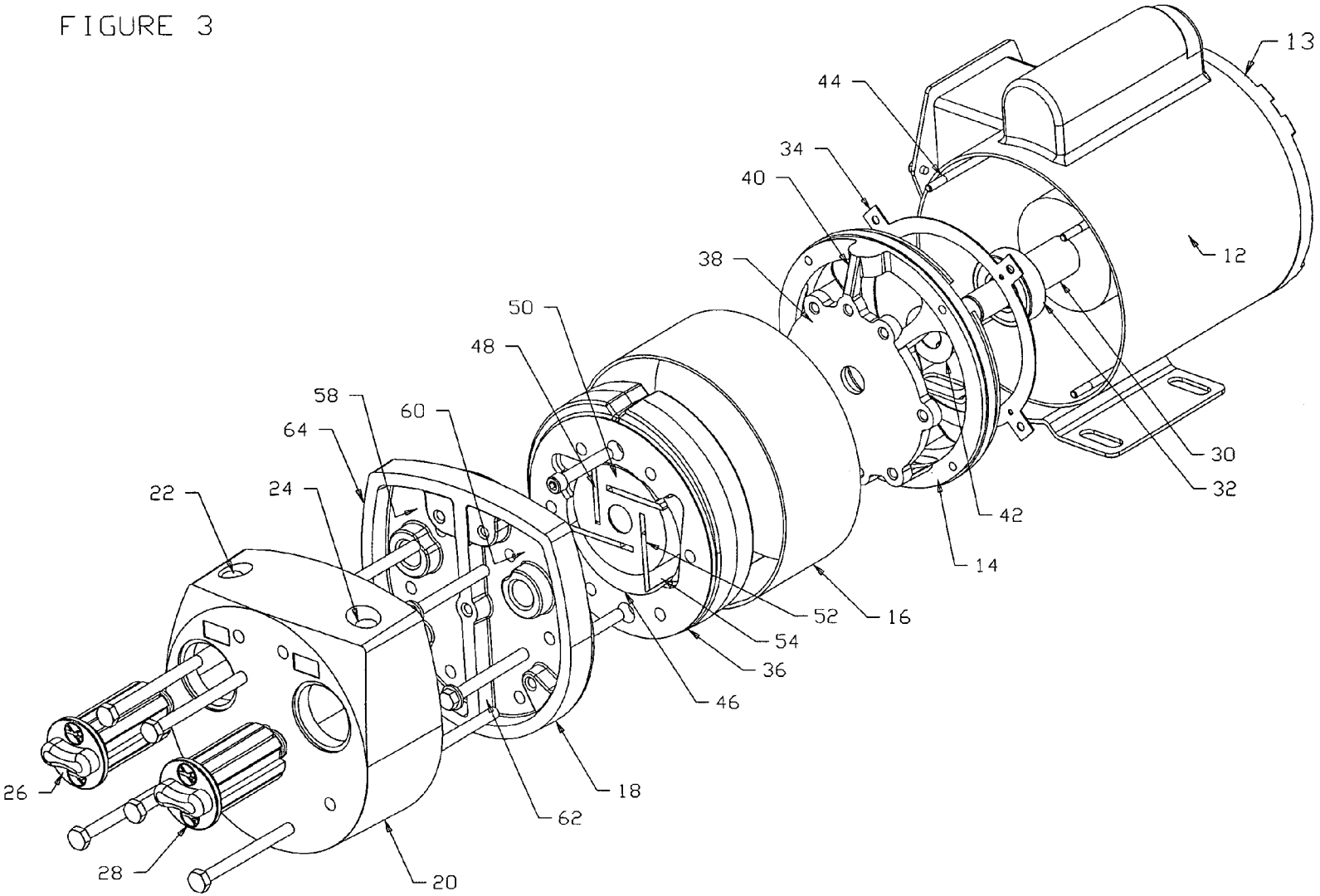
FIG. 3 is an exploded isometric view of components of the compressor of FIG. 1.

Referring now to FIG. 3, an exploded view of the compressor is shown and the internal mechanism can be seen. In the housing there is positioned an electric motor which can be generally characterized as a one-sixth horsepower motor, having a four pole stator and a six pole rotor. The housing 12 has a maximum length of about 5.22 inches so as to reduce the vibrations. The motor's rotor drives a drive shaft 30 which is mounted on a plurality of deep groove ball bearings 32.

An inlet ring 34 is positioned against the motor housing 12. There is provided the rear plate 14 which includes a centrally positioned bolting and bearing support section 38 which is held in position by a plurality of webs such as 40. It is seen that the drive shaft 30 is also supported by a second set of bearings 42 which is secured to the section 38. The rear plate 14 is secured to the motor housing with the inlet ring 34 positioned therebetween like a gasket. Bolts such as 44 from the motor housing are secured to the periphery of the rear plate 14. The shroud 16 is non-vented and made of a laminated material and fits against the rear plate 14.

The body 36 defines a rotor cavity 46 therein, fits within the shroud 16, has a radius of at least about 2.62 inches, a minimum weight of about 4.63 pounds, and is made of a gray iron casting, more specifically SAE J4321 G2500. A rotor and vane assembly 48 is positioned within the cavity 46. The drive shaft 30 extends to and engages the rotor and rotates the assembly 48. The assembly 48 includes the rotor 50 and four vane receiving slots such as 52 within each of which there is a positioned a vane 54. It will be appreciated that the motor rotates the drive shaft which, in turn, rotates the assembly 48 for compressing incoming air and expelling compressed air. When the rotor is rotated, each vane can slide within a rotor slot and can engage the cavity wall or body 36. The front plate 18 engages the front face of the body 36 and is divided into two chambers or sections 58 and 60 by the by a central rib 62 and peripheral edge 64. The muffler box 20 which is preferably made from a gray iron, but can be made from die cast aluminum, is secured against the front end plate. The muffler box defines the exit and inlet ports 22 and 24 and each communicates with a chamber 58 or 60. The muffler box is deep enough to receive the muffler elements 26 and 28.

Figure 4:
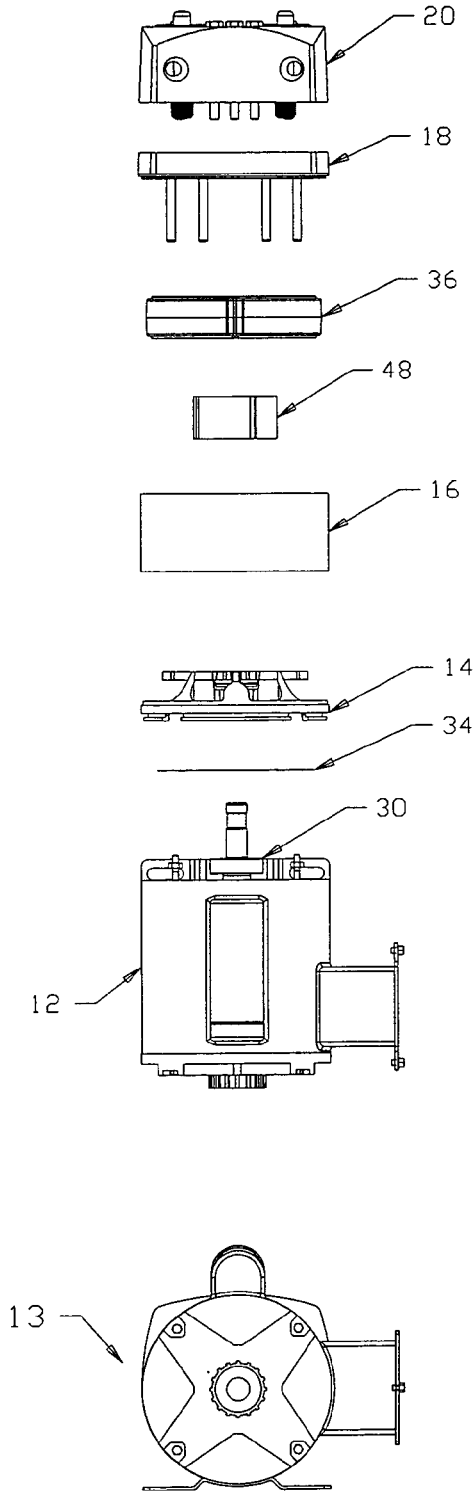
FIG. 4 is a top or elevational and exploded view of components shown in FIG. 3.

Elements or components of the compressor are also seen in FIG. 4 and include the motor housing 12, the drive shaft 30, the inlet ring 34, the rear plate 14, the shroud 16, the rotor assembly 48, the body 36, the front plate 18 and muffler box 20.

Inlet Ring

Figure 5:
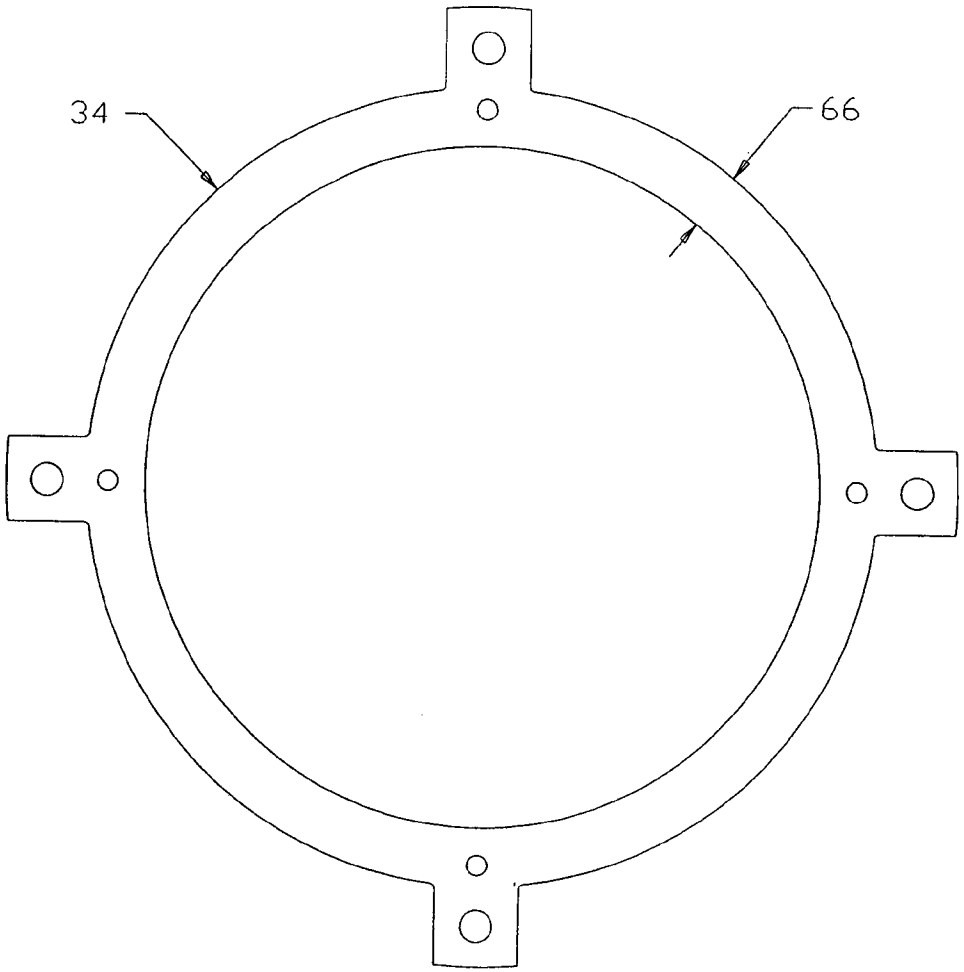
FIG. 5 is a front view of an improved inlet ring used in the compressor of FIG. 1.

The inlet ring 34 is seen in FIG. 5. The ring 34 has a small wall thickness 66 [i.e., the difference between the outside diameter (OD) and inside diameter (ID)] of about 1.25 inches and is made of 20 gage cold rolled steel. The ring is positioned between the motor housing 12 and the rear plate 14. The ring is crushable and acts like a gasket to seal against both the housing and plate. The ring OD is fixed by the compressor size and the ID is increased as much as possible so as to reduce vibration and maintain sealing.

The Body

Figure 6:
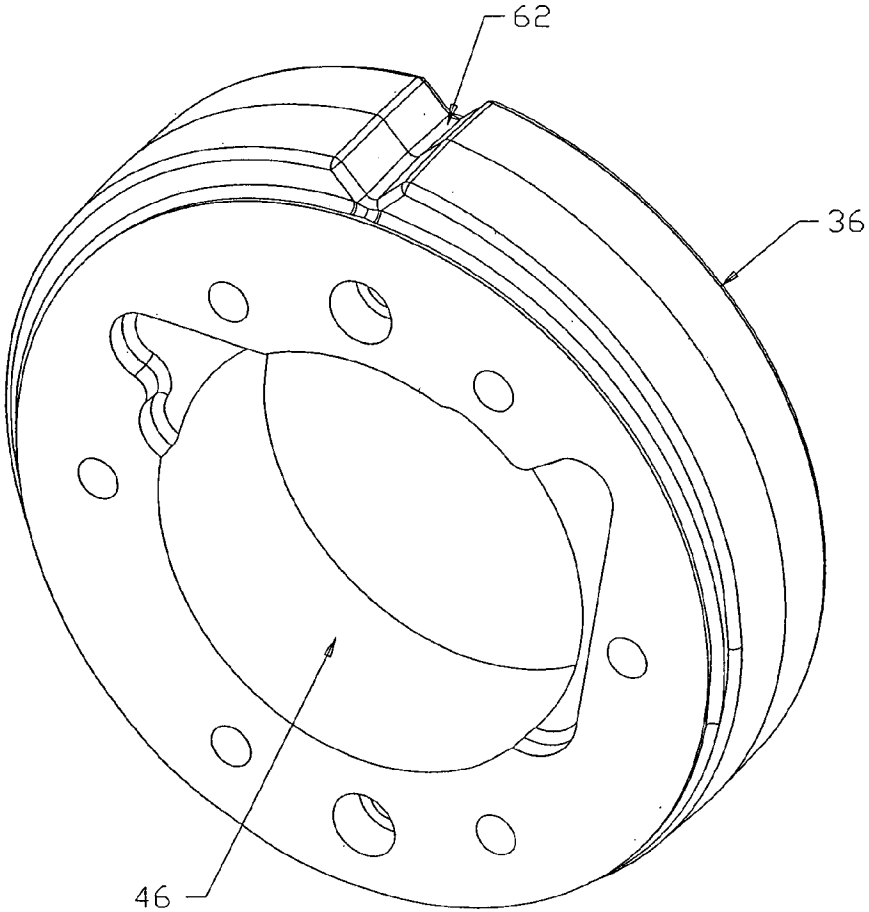
FIG. 6 is a perspective view of the body used in the compressor of FIG. 1.
Figure 7:
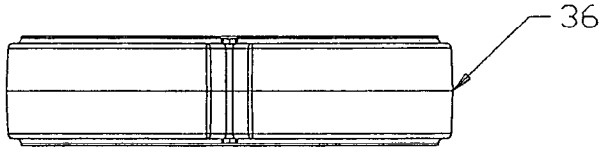
FIG. 7 is a top view of the body of FIG. 6.
Figure 8:
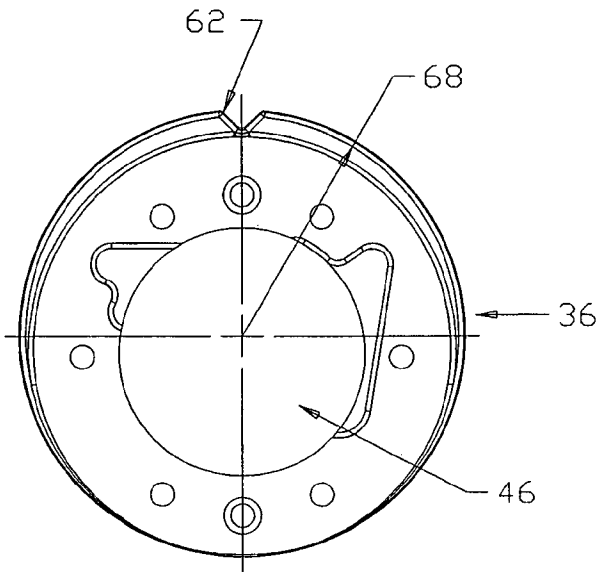
FIG. 8 is a front view of the body of FIG. 6.

The body 36 is shown in FIGS. 6, 7 and 8. The body 36 has a positioning groove 62 located at the top thereof, has an increased mass or, a weight of about 4.63 pounds, as well as an increased outer radius 68 of about 2.62 inches. The body 36 is fabricated from a first sound dampening material, which in a preferred embodiment,is gray iron, as specified hereinbefore, which exhibits good sound-dampening characteristics. In addition, the size, weight and mass of the body is maximized so as to maximize sound dampening. The outside diameter is increased, but is limited by the size of the compressor. The inside diameter or cavity is maintained for cooperation with the rotor assembly.

Rotor

Figure 9:
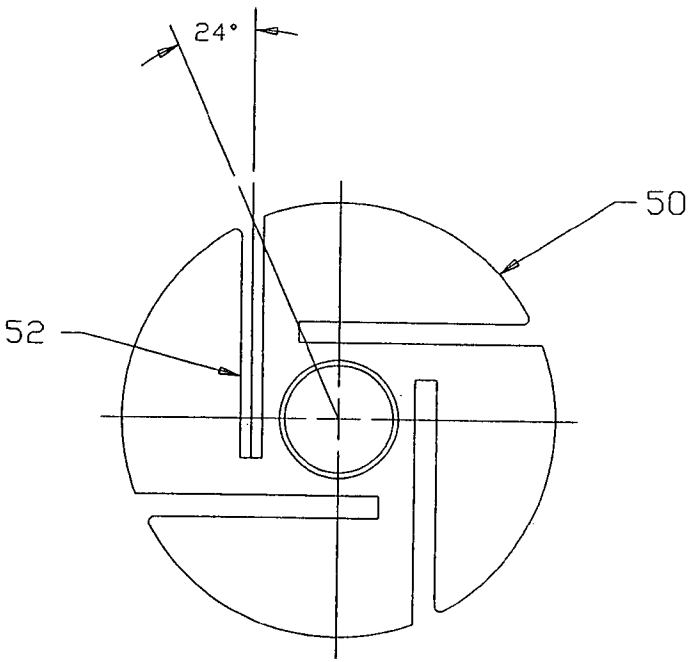
FIG. 9 is a front view of the vane-carrying rotor used in the compressor of FIG. 1.

The rotor body 50 which has vane-carrying slots such as 52 is shown in FIGS. 3 and 9. Each of the slots carries a vane, extends into the rotor body, is at right angles to an adjacent vane slot and forms a chord-like construction which extends from the circumference or periphery of the rotor into the rotor body as shown. The positioning of the slot relative to the center and relative to the other slots is important in reducing the sound of operation. The angular relation between the centerline of a vane receiving slot and a line passing through the rotor center and the center of the vane slot opening at the periphery of the rotor is about 24°. The angular relation can vary between 23° and 25°. This angular relationship is important as it permits vane movement in the slot and reduces vane bounce during rotation. The mass or weight of each vane is important to maximize radial force. The weight of the vane herein is about 6.75 grams. The combination of vane mass and angular relation also reduces vane bounce and noise.

The Shroud

Figure 10:
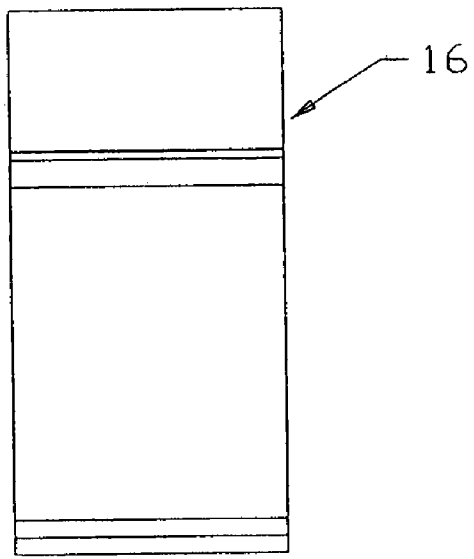
FIG. 10 is a side view of the rotor used in the compressor of FIG. 1.
Figure 12:
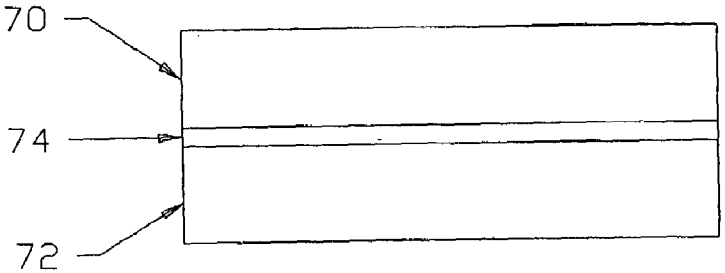
FIG. 12 is a sectional view of the shroud taken along line 12—12 of FIG. 11 and showing the laminated construction of the shroud.
Figure 11:
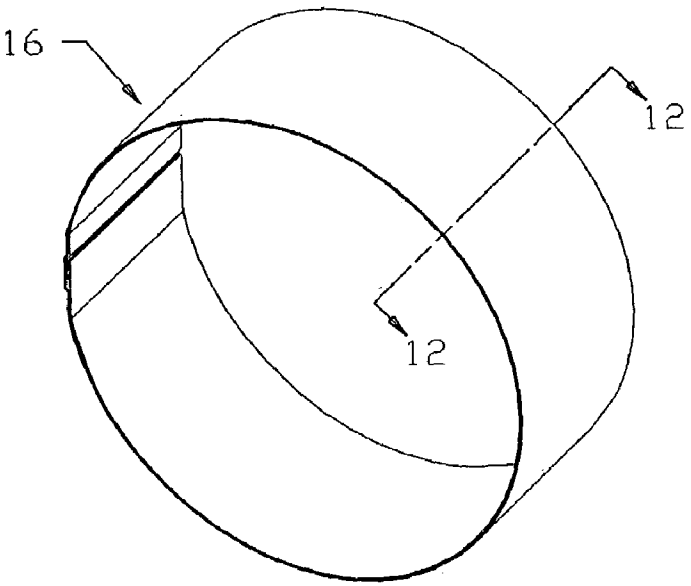
FIG. 11 is a perspective view of a non-vented cylindrical shroud used in the compressor of FIG. 1.

FIGS. 10, 11 and 12 show the shroud 16. The shroud 16 is a cylindrical member which fits about the body 18 and engages the rear plate 14 and the front plate 56. The shroud is a solid non-vented member which can be made of a laminated structure seen in FIG. 12. The laminated structure may include at least one of an outer metal layer 70 and an inner metal layer 72. Also, the laminated structure includes and an intermediate viscous layer 74 made from a second sound dampening material.The solid or non-vented structure and the laminated structure contributes to the dampening or sound reduction. The inner and outer layers are 24 to 26 gauge Galvaneal steel (Galvaneal steel is electro-galvanized steel which is made for painting) and the sound dampening material is a viscous material such as Acrylic pressure sensitive adhesive. The laminate can be purchased from Roush Anatrol Main Office, 11953 Market Street, Livonia, Mich. 48100, under the trade name Anatrol 980.

Bearings

The bearings such as 32 and 42 are referred to as deep groove ball bearings (See NSK catalog, Rolling Bearings, Cat. No. A 140b, 19933-10 Printed in Japan, Copyright NSK Ltd. 1989) are sealed and utilize a grease or lubricant to dampen sound. This grease or lubricant is a polyurea grease (available as POLYREX EM, from Exxon Mobile Corporation, 3225 Gallows Road, Fairfax, Va. 22037. The combination of the deep groove bearing and grease reduce the sound of operation.

Motor and Housing

The motor itself is one-sixth horse power, 6-pole rotor and 4-pole stator type. The motor housing is less than about 5.22 inches in length and is solid or non-vented. Sound emanating from the motor during operation has been minimized.

The back or closure 13 for the motor housing 12 is a solid non-vented member which is secured to the housing. The fact that the back is solid and non-vented minimizes sound emanating from the rear of the compressor.

Summary

The combination of above-identified factors reduces the sound emitted from the compressor during operation to about 50 dB at 1 meter. Those factors include the solid non-vented motor housing 12, the solid non-vented housing back 13, the 6-pole rotor 4-pole stator motor, the deep groove bearings 32 and 42 and lubricant, the rotor-vane angular relationship and vane weight or mass, the increased body size and mass 18 and the non-vented solid or laminated shroud 16. In addition, the muffler 20 can be made of various materials so as to enhance the sound deadening property.

It will be appreciated that numerous changes and modifications can be made to the embodiments detailed above.

The invention claimed is:

1. A rotary vane compressor which exhibits reduced sound of operation and comprises:

a motor;

a non-vented housing surrounding said motor;

a non-vented back or closure secured to one end of said housing;

a drive shaft extending from and operatively associated with said motor;

at least one deep groove ball bearing for supporting said drive shaft and having a sound dampening grease sealed within said bearing;

a rotor with vane receiving slots coupled to said drive shaft for rotation therewith;

a body which defines a cavity within which said rotor rotates, said body fabricated of a first sound dampening material;

a non-vented shroud which surrounds the body, said shroud comprising laminated layers of at least one layer of metal and at least one layer of a second sound dampening material;

a front plate engaging the body in defining a pair of air conducting chambers; and a muffler box which engages the front plate and defines an inlet port and an outlet port, each of which communicates with one of said chambers.

2. A rotary vane compressor as in claim 1 wherein an angular relation between a centerline of a vane receiving slot, and a line passing from an axial center of the rotor and a center of a vane receiving slot opening thereof at a periphery of the rotor ranges from about 23° to about 25°.

3. A rotary vane compressor as in claim 2 wherein the angular relation is about 24°

4. A rotary vane compressor as in claim 2 wherein each vane weighs about 6.75 grams

5. A rotary vane compressor as in claim 1 wherein said first sound dampening material is grey iron.

6. A rotary vane compressor as in claim 1 wherein said muffler box is fabricated of grey iron

7. A rotary vane compressor as in claim 1 wherein said second sound dampening material is acrylic.

8. A rotary vane compressor as in claim 1 wherein said body is substantially circular and has an outer radius of no less than about 2.6 inches.

9. A rotary vane compressor as in claim 1 wherein said body weighs no less than about 4.63 lbs.

10. A rotary vane compressor as in claim 1 wherein said motor housing is no more than about 5.22 inches in length.

11. A rotary vane compressor as in claim 1 wherein a rear plate is coupled to said motor housing for additional support of said drive shaft

12. A rotary vane compressor as in claim 11 wherein an inlet ring engages said motor housing and said rear plate, said inlet ring fabricated of crushable steel and sealing against both the motor housing and the rear plate.

13. A rotary vane compressor which exhibits reduced sound of operation and comprises:

a motor;

a non-vented housing surrounding said motor;

a non-vented back or closure secured to one end of said housing;

a drive shaft extending from and operatively associated with said motor;

at least one deep groove ball bearing for supporting said drive shaft and having a sound dampening grease sealed within said bearing;

a rotor with vane receiving slots coupled to said drive shaft for rotation therewith, wherein the angular relation between the centerline of a vane receiving slot, and a line passing through the center of the rotor and the center of the vane receiving slot opening thereof at the periphery of the rotor is from about 23°to about 25°;

a body which defines a cavity within which said rotor rotates, said body fabricated of grey iron and weighing no less than about 4.63 lbs;

a non-vented shroud which surrounds the body, said shroud comprising laminated layers of at least one layer of metal and at least one lay of a sound dampening material;

a front plate engaging the body in defining a pair of air conducting chambers; and a muffler box which engages the front plate and defines an inlet port and an outlet port, each of which communicates with one of said chambers.

14. A rotary vane compressor as in claim 13 wherein each vane weighs about 6.75 grams.

15. A rotary vane compressor as in claim 13 wherein said muffler box is fabricated of grey iron.

16. A rotary vane compressor as in claim 13 wherein said sound dampening material is acrylic

17. A rotary vane compressor as in claim 13 wherein said body is substantially circular and has an outer radius of no less than about 2.6 inches.

18. A rotary vane compressor as in claim 13 wherein said motor housing is no more than about 5.22 inches in length.

19. A rotary vane compressor as in claim 13 wherein a rear plate is coupled to the motor housing through an inlet ring for additional support of said drive shaft, said inlet ring fabricated of crushable steel and sealing against both the motor housing and the rear plate.

20. A rotary vane compressor which exhibits reduced sound of operation and comprises:

a motor;

a non-vented housing surrounding said motor;

a non-vented back or closure secured to one end of said housing;

a rear plate coupled to said motor housing through an inlet ring for additional support of said drive shaft, said inlet ring fabricated of crushable steel and sealing against both the motor housing and the rear plate;

a drive shaft extending from and operatively associated with said motor;

at least one deep groove ball bearing for supporting said drive shaft and having a sound dampening grease sealed within said bearing;

a rotor with vane receiving slots coupled to said drive shaft for rotation therewith, wherein an angular relation between the centerline of a vane receiving slot and a line passing through the center of the rotor and the center of the vane receiving slot opening thereof at the periphery of the rotor is from about 23°to about 25°;

a body which defines a cavity within which said rotor rotates, said body a front plate engaging the body in defining a pair of air conducting chambers; fabricated of grey iron and weighing no less than about 463 lbs; P1 a non-vented shroud which surrounds the body, said shroud comprising laminated layers of at least one layer of metal and at least one layer of a sound dampening material;

a front plate engaging the body in defining a pair of air conducting chambers; and a muffler box which engages the front plate and defines an inlet port and an outlet port, each of which communicates with one of said chambers.

* * * * *

UNITED STATES PATENT AND TRADEMARK OFFICE

CERTIFICATE OF CORRECTION

PATENT NO. : 7,189,068 B2
APPLICATION NO. : 10/666061
DATED : March 13, 2007
INVENTOR(S) : Thomas, Jr. et al.

It is certified that error appears in the above-identified patent and that said Letters Patent is hereby corrected as shown below:

Column 6, line 47, please delete “463” and insert -- 4.63 --; and

Column 6, line 48 please delete “P1”

Signed and Sealed this

Twenty-fourth Day of June, 2008

JON W. DUDAS
*Director of the United States Patent and Trademark Office*